US006926097B1

(12) United States Patent
Blake

(10) Patent No.: US 6,926,097 B1
(45) Date of Patent: Aug. 9, 2005

(54) JACK UP WORKOVER RIG WITH REMOVABLE WORKOVER FLOOR UNIT

(76) Inventor: Michael E. Blake, 1704 Broken Brauth St., Metairie, LA (US) 70005

( * ) Notice: Subject to any disclaimer, the term of this patent is extended or adjusted under 35 U.S.C. 154(b) by 36 days.

(21) Appl. No.: 10/382,607

(22) Filed: Mar. 6, 2003

Related U.S. Application Data

(60) Provisional application No. 60/362,517, filed on Mar. 6, 2002.

(51) Int. Cl.[7] ..... E21B 15/02
(52) U.S. Cl. ..... 175/9; 166/343; 405/196
(58) Field of Search ..... 405/195.1, 196, 405/203–205; 175/7, 9, 10; 166/343, 354

(56) References Cited

U.S. PATENT DOCUMENTS

| | | | | |
|---|---|---|---|---|
| 4,456,404 A * | 6/1984 | Evans | ..... | 405/196 |
| 5,997,217 A * | 12/1999 | Verret | ..... | 405/196 |
| 6,523,491 B1 | 2/2003 | Moise, II et al. | ..... | 114/265 |
| 6,607,331 B2 * | 8/2003 | Sanders et al. | ..... | 405/196 |

OTHER PUBLICATIONS

Offshore Magazine's Editorial Schedule and Market Planner, Oct. 1, 1994.

Ocean Energy Inc.'s article entitled "Why pay for more rig than you need," Houma, Louisiana, undated.

Houtech Energy, Inc.'s Marine Workover/Drilling Unit Brochure, Stafford, Texas, undated.

Photograph of Drilling Rig, Venezuela, undated.

Pressure Services, Inc.'s Drawing of Outboard Profile of Liftboat, Houma, Louisiana, Aug. 10, 1981.

* cited by examiner

*Primary Examiner*—Zakiya Walker
(74) *Attorney, Agent, or Firm*—Roy, Kiesel, Keegan & DeNicola

(57) ABSTRACT

An offshore jack-up workover rig. The workover rig includes a vessel which may be self powered or powered by a tug. The vessel may be raised above the surface of a water body by extending the legs until they reach the water body bed and then continuing to extend the legs. The workover rig contains a workover floor unit which includes at least a drawworks, a drawworks motor, and a well aperture. The workover rig is detachably mounted on an extensible cantilevered frame. The frame may be extended to position the workover floor unit over an offshore platform to be serviced. The workover floor unit is also configured to mover laterally relative to the extensible frame. The vessel is also provided with a crane. The crane may be used to lift the detachable workover floor unit from the vessel and deposit it, including its equipment, on the platform.

4 Claims, 18 Drawing Sheets

JACK UP WORKOVER RIG WITH REMOVABLE WORKOVER FLOOR UNIT

Priority claim: This application claims priority of, and hereby incorporates by reference the contents of U.S. Provisional Application No. 60/362,517, filed Mar. 6, 2002.

BACKGROUND OF THE INVENTION

1. Field of the Invention

The invention relates to work over vessels in general and jack-up work over vessels in particular.

2. Prior Art

Oil and gas wells must be serviced occasionally for a number of reasons. For example, valves or seals may need to be replaced; flanges may need to be removed or installed in the wellhead; and blowout preventers may need to be removed, added, or serviced. The well may need production treatment, such as fracturing or acidizing, to stimulate the production of oil or gas therefrom. During treatment, the wellhead may need to be removed for well stimulating chemicals to be injected into the well. The packers and anchors in the well may need to be removed or reseated. Production tubing and well line tools may need to be removed from or run into the well. All of the foregoing are typically done with a workover rig.

Workover rigs typically comprise a derrick and pulleys or block and tackle devices that are used to extract the above described devices and related hardware from the well or to insert the same into the well. Although a workover rig has many functions, one of its principle purposes is to exert a vertical lifting force on the components in the well. In land based wells, this is simple enough. The workover rig is brought to well, and placed directly over the well, either with a mobile workover rig that can be rolled into the proper position or with a crane or other similar lifting device.

In offshore wells, proper placement of the workover rig is more difficult. The workover rig must be brought to the platform, usually on a barge powered by a tugboat. A separate vessel having a crane is then used to lift the workover rig onto to the drilling platform and position the same over the well. A platform may have many different wells originating therefrom. The crane will need to move the workover rig into position over each well so that each may be serviced. Once the well servicing is complete, the crane will return the workover unit to the barge for return.

Typically, the workover rig, the barge and tugboat, and the secondary vessel with the crane are leased by the day. Thus, maintaining both of these vessels and their crews during workover can be quite expensive. Therefore, a vessel that can meet the following objectives is desired.

OBJECTS OF THE INVENTION

It is an object of the invention to provide a workover vessel capable of performing all workover tasks at an offshore platform from a single vessel.

It is another object of the invention to provide a workover vessel which may be jacked into place at an offshore platform.

It is still another object of the invention to provide a workover vessel which has an extensible workover platform.

It is yet another object of the invention to provide a workover vessel which has a detachable workover platform.

SUMMARY OF THE INVENTION

The invention comprises a jack up workover vessel with an extensible detachable workover floor unit. The vessel may be either a barge or a self powered motor vessel. In either case, the vessel will be motored into position at an offshore platform. The vessel will have a plurality of legs, each of which is preferably provided with a jacking mechanism capable of raising and lowering the legs. When the vessel in place adjacent to the rig to be serviced, the legs will be extended until they reach the floor of the ocean or other water body. Continued extension of the legs will cause the vessel to be jacked up on the legs until a desired height is achieved, typically such that the deck of the vessel is higher than the deck of the platform.

The location of the well on the platform will determine how the process will proceed from there. The vessel is provided with an extensible cantilevered frame. The workover floor unit is mounted to the distal end of this cantilevered frame. If the well is within the reach of the cantilevered frame, the vessel will simply extend the workover floor unit out over the well and work will proceed from workover floor unit with it still attached to extensible frame. The workover floor unit is configured to slide horizontally on the extensible frame to facilitate placement of the workover floor unit directly over the well.

If the well is further from any edge of the platform than the extensible frame can reach, eighteen feet in the preferred embodiment, one of two approaches may be taken. In the first approach, the vessel is motored into position and jacked to the desired height as before. However, the vessel is provided with a deck crane and will carry a plurality of skid beams. The crane will position these at least two of the skid beams on the deck of the platform, preferably on either side of the well and generally perpendicular to the alignment of the workover floor unit. The workover rig will then extend its cantilevered frame until the frame and the workover floor unit are positioned over the skid beams. The workover vessel should be positioned so that the cantilevered frame is not in alignment with the skid beams. By positioning the vessel so, the jack up vessel may be lowered until the workover floor unit is resting on the skid beams without the extensible frame hitting the skid beams first. Alternatively, a hydraulic lift could be provided for the cantilevered extensible frame. In either event, the workover floor unit is lowered onto the skid beams.

Once the workover floor unit is resting on the skid beams, the workover floor unit will be detached from the cantilevered frame and the frame will be retracted. The extensible frame will then engage the skid beams, either by adding a physical connector such as another beam or by repositioning the vessel to align the extensible frame with the skid beams. Once the extensible frame and the skid beams are engaged, the extensible frame may be used to drive the skid beams across the deck of the platform until the workover platform is properly positioned over the well on the platform. When workover is complete, the crane on the vessel may be used to return the workover floor unit and the skid beams to the vessel.

The second approach is particularly useful when the well to be serviced is beyond about thirty-six feet from the closest edge of the platform or if intervening structures prevent the above described "skid-off" procedure from being used. In this approach, the vessel is motored into place and jacked up until the vessel deck is at the desired height. Additionally, the vessel crane is used to position at least two skid beams on the platform on either side of the well. However, at this point, the workover floor unit is detached from the vessel. The crane is used to move the workover floor unit onto the skid beams and into position over the well. Once workover is complete, the crane can return the workover floor unit and the skid beams to the vessel. The foregoing procedures allow a single vessel to be used to provide workover service to platforms, substantially reducing the cost of workover operations to the well operator.

DETAILED DESCRIPTION OF THE PREFERRED EMBODIMENT

Figure 1:
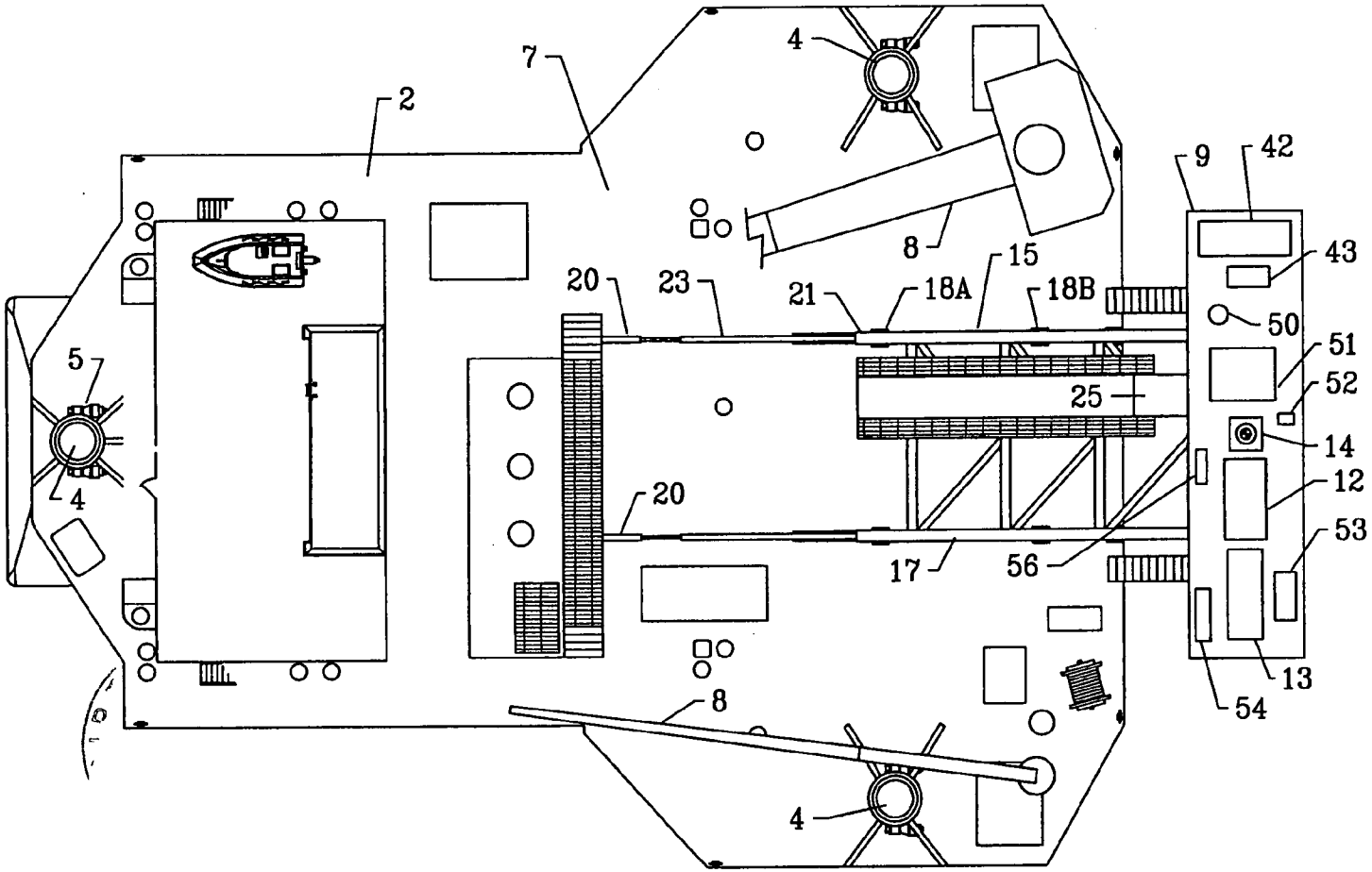
FIG. 1 is a plan view of a preferred embodiment of the jack-up workover rig.
Figure 2:
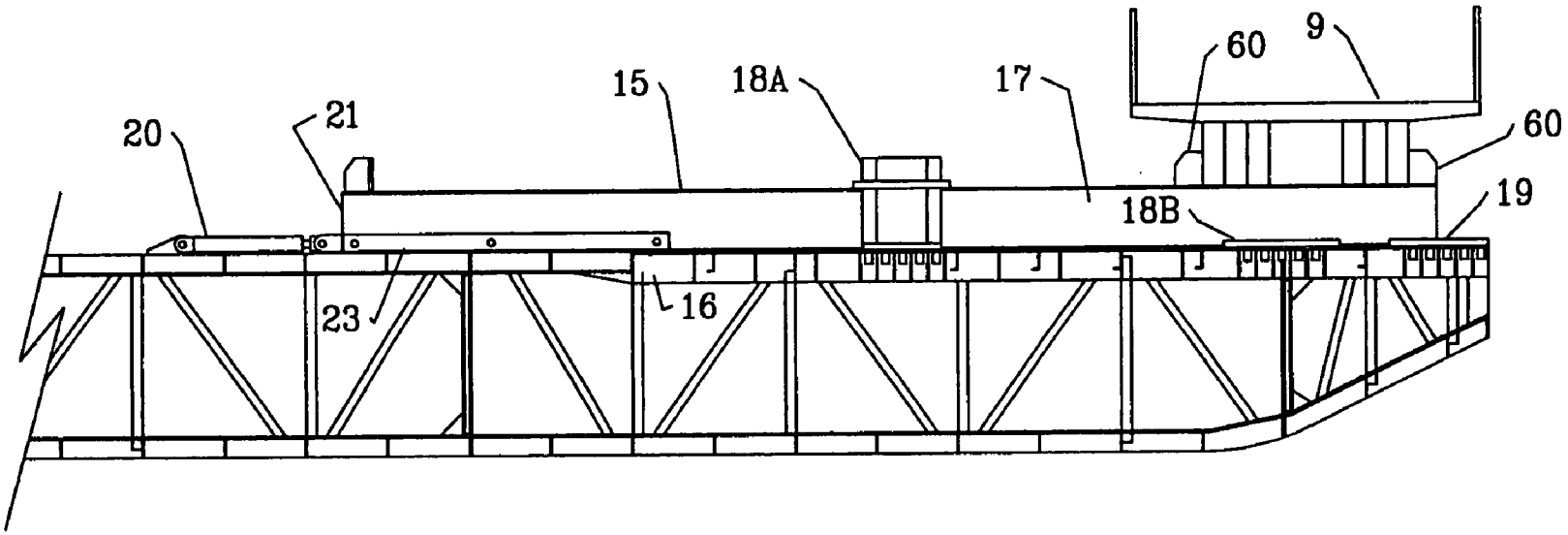
FIG. 2 is a side cut-away view showing a preferred embodiment of the extensible cantilevered frame retracted.
Figure 3:
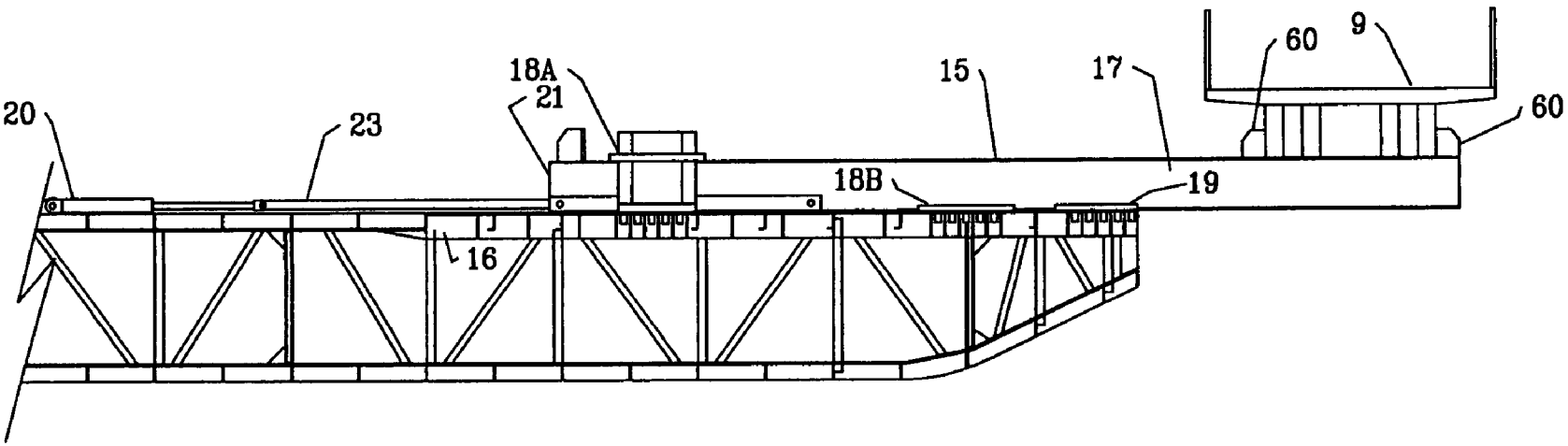
FIG. 3 is a side cut-away view showing a preferred embodiment of the extensible cantilevered frame extended.
Figure 4A:
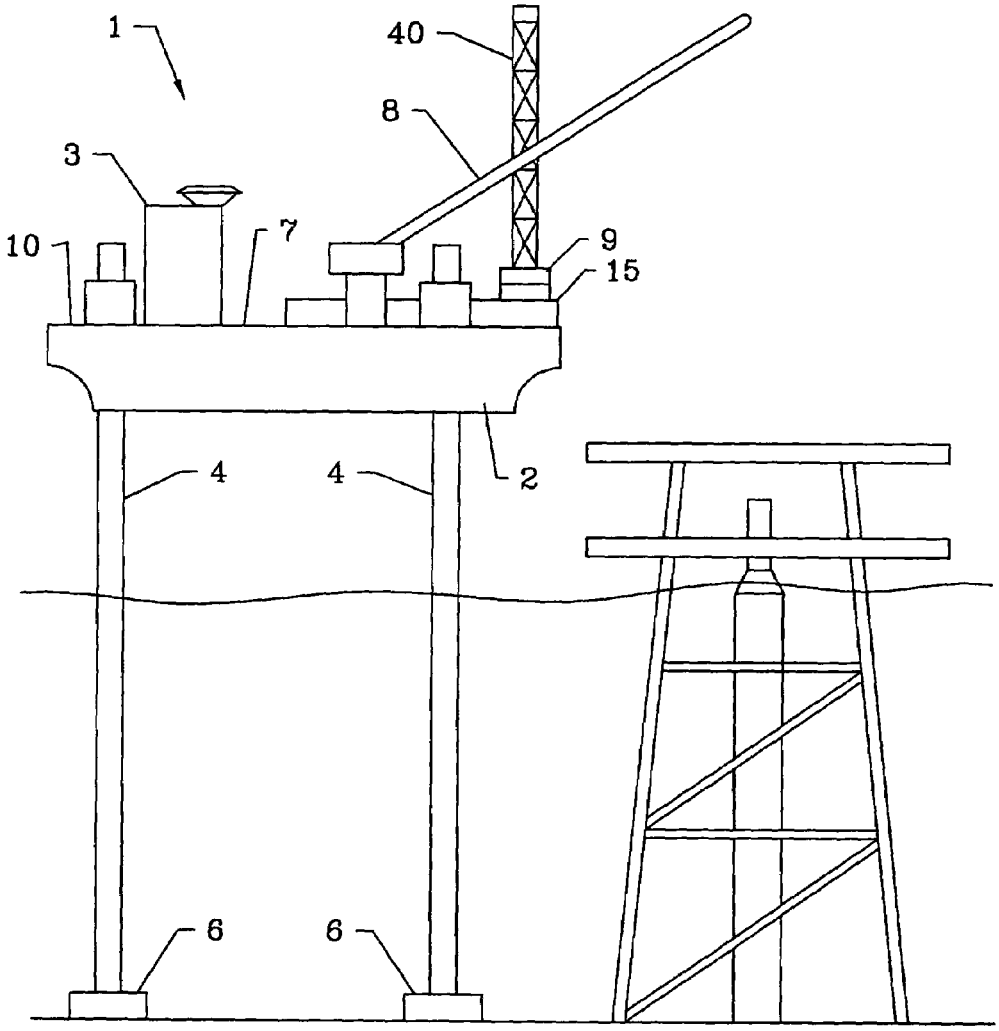
FIG. 4A is a side view showing a preferred embodiment of the jack-up workover rig jacked up and adjacent to an offshore platform.
Figure 4B:
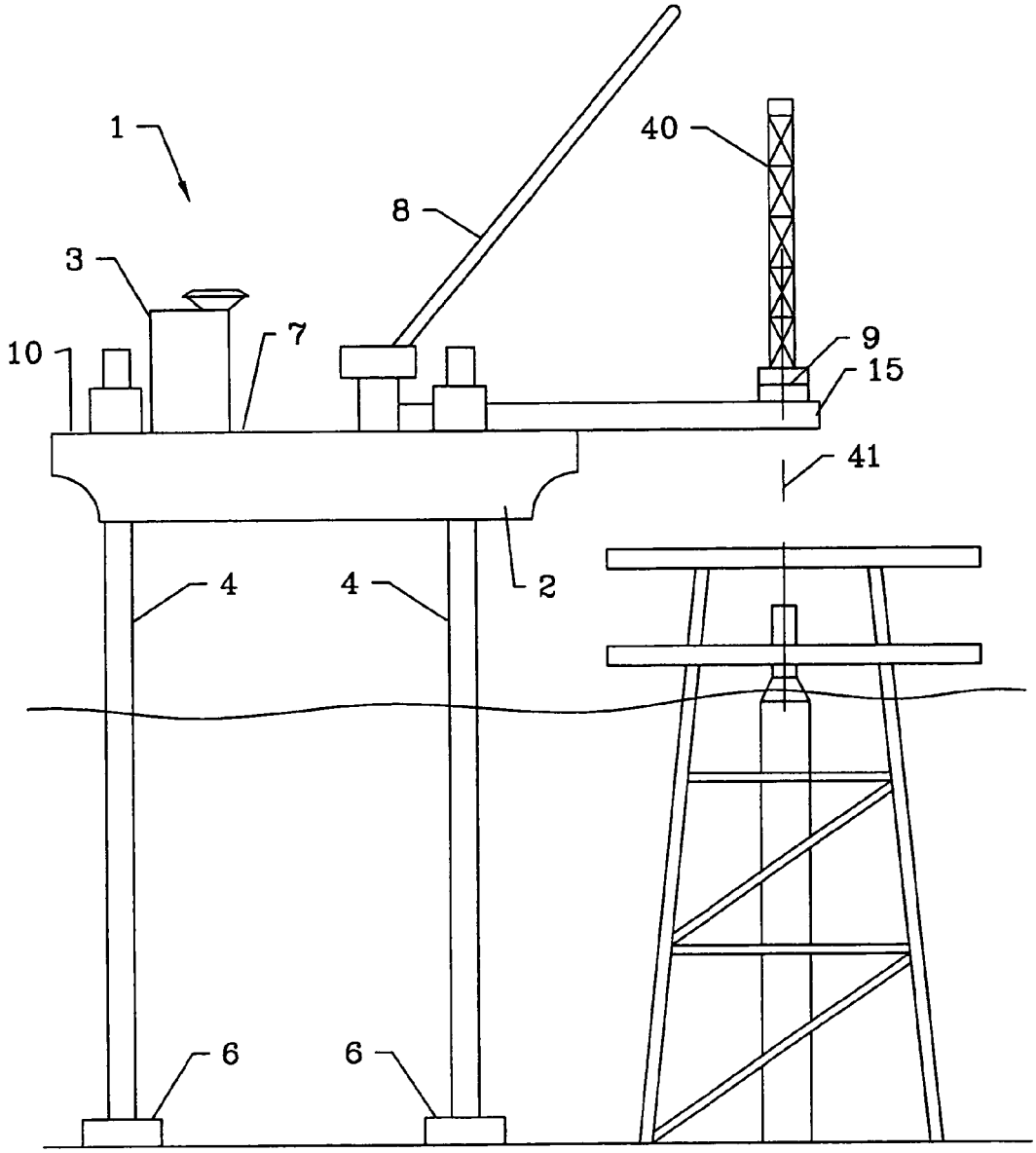
FIG. 4B is a side view showing a preferred embodiment of the jack-up workover rig with the workover floor unit extended on the extensible frame over an offshore platform.
Figure 5A:
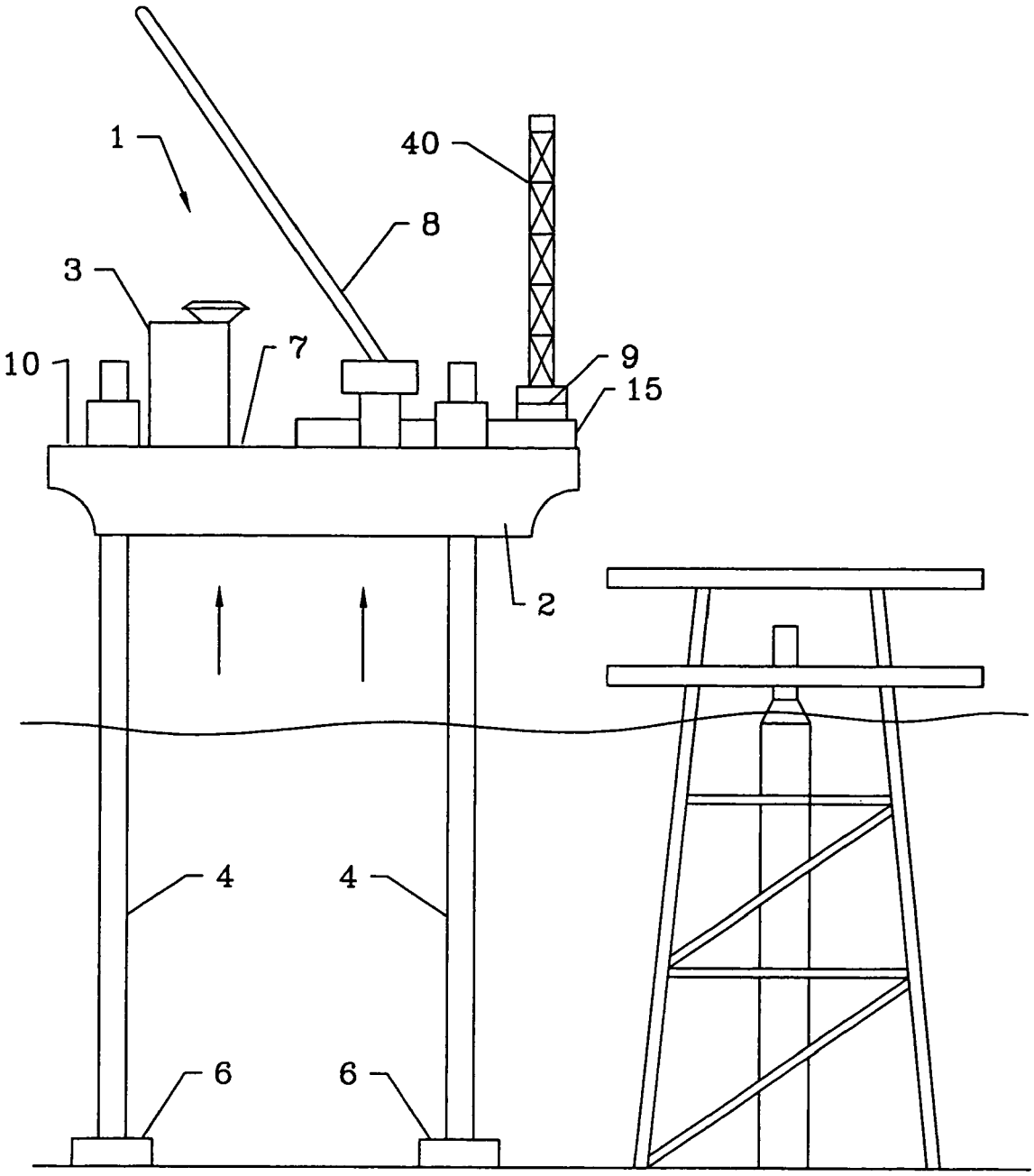
FIG. 5A is a side view showing a preferred embodiment of the jack-up workover rig jacking up into position adjacent to an offshore platform.
Figure 5B:
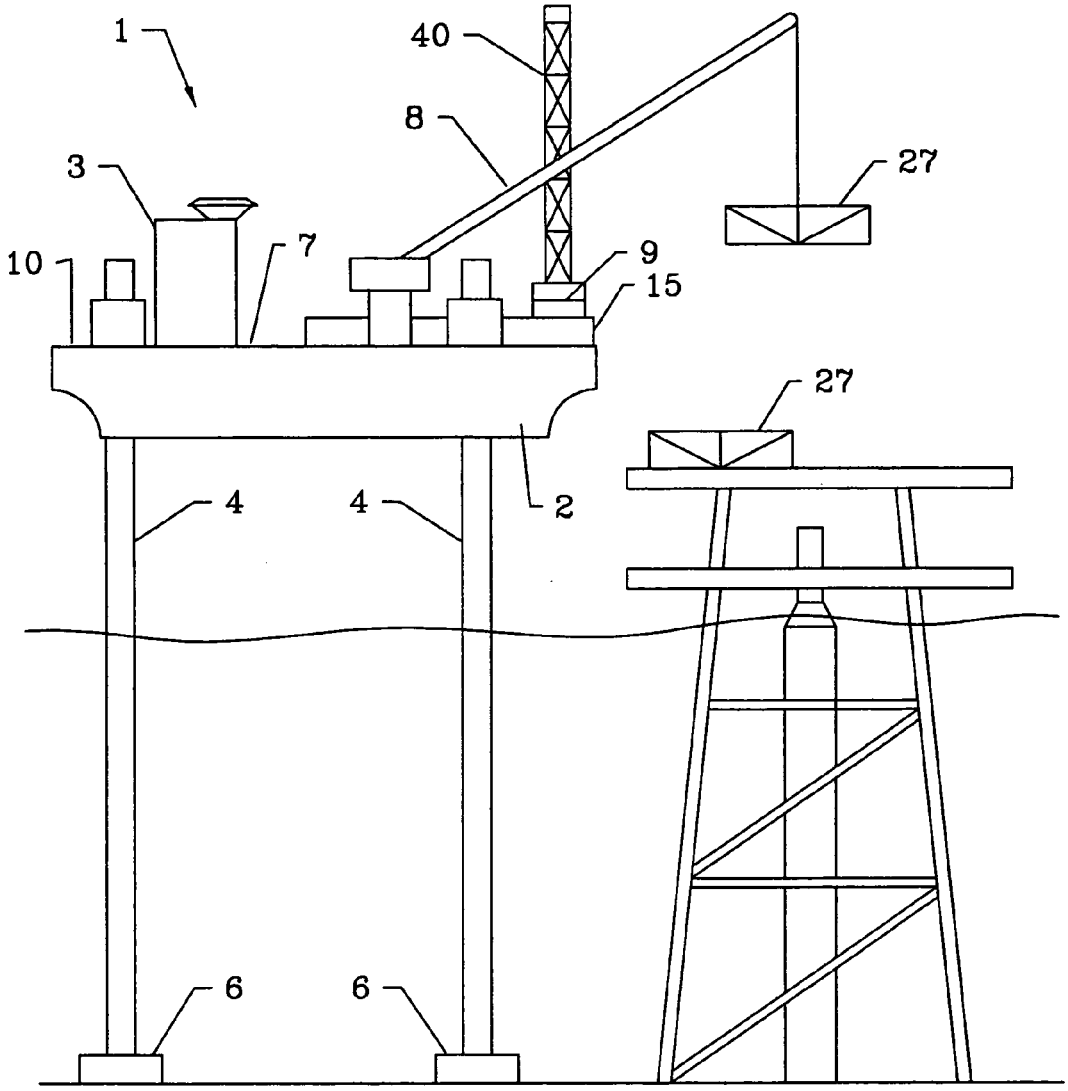
FIG. 5B is a side view showing a preferred embodiment of the jack-up workover rig using a crane to position skid beams on an offshore platform.
Figure 5C:
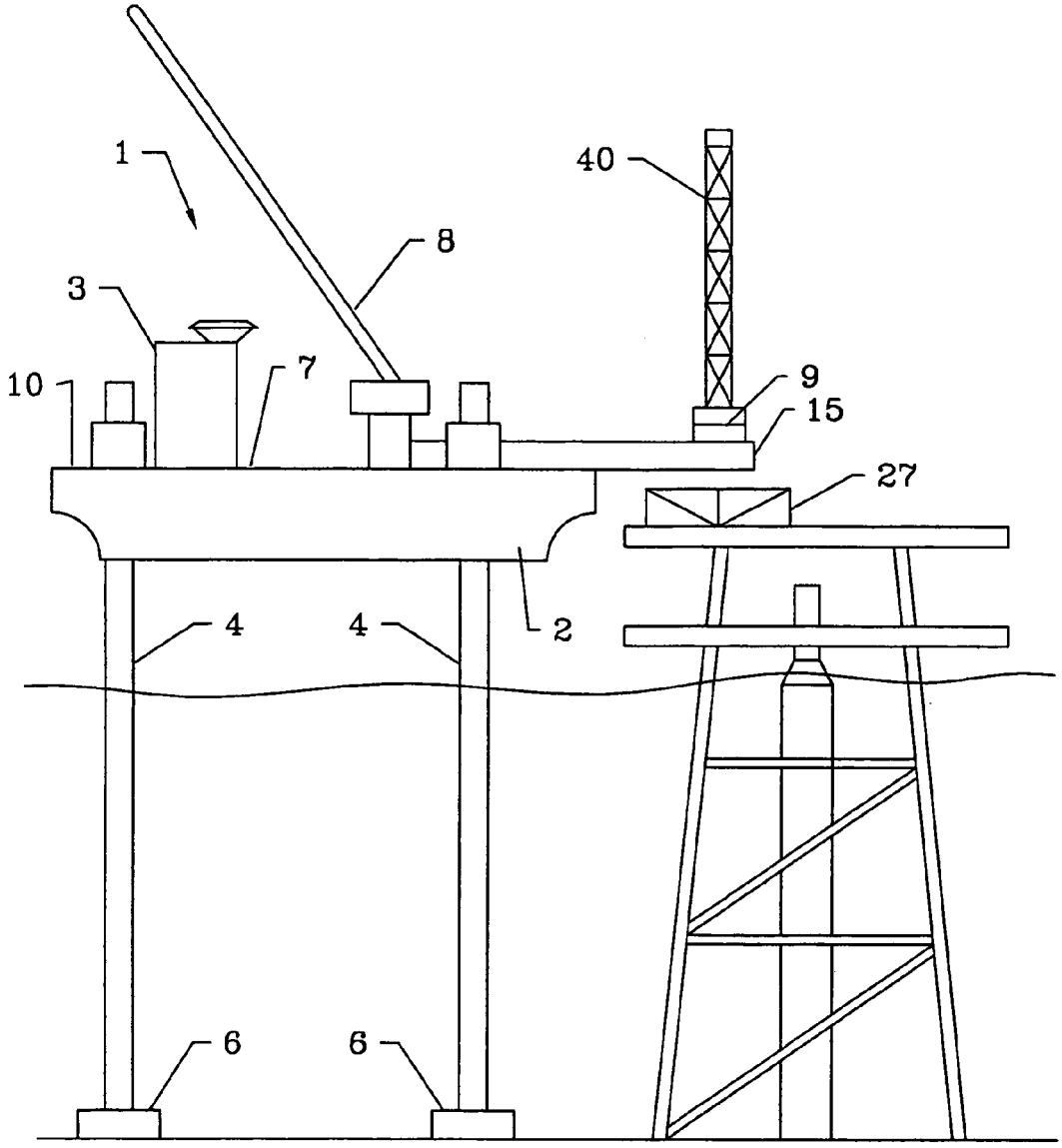
FIG. 5C is a side view showing a preferred embodiment of the jack-up workover rig extending its extensible frame and workover floor unit over an offshore platform.
Figure 5D:
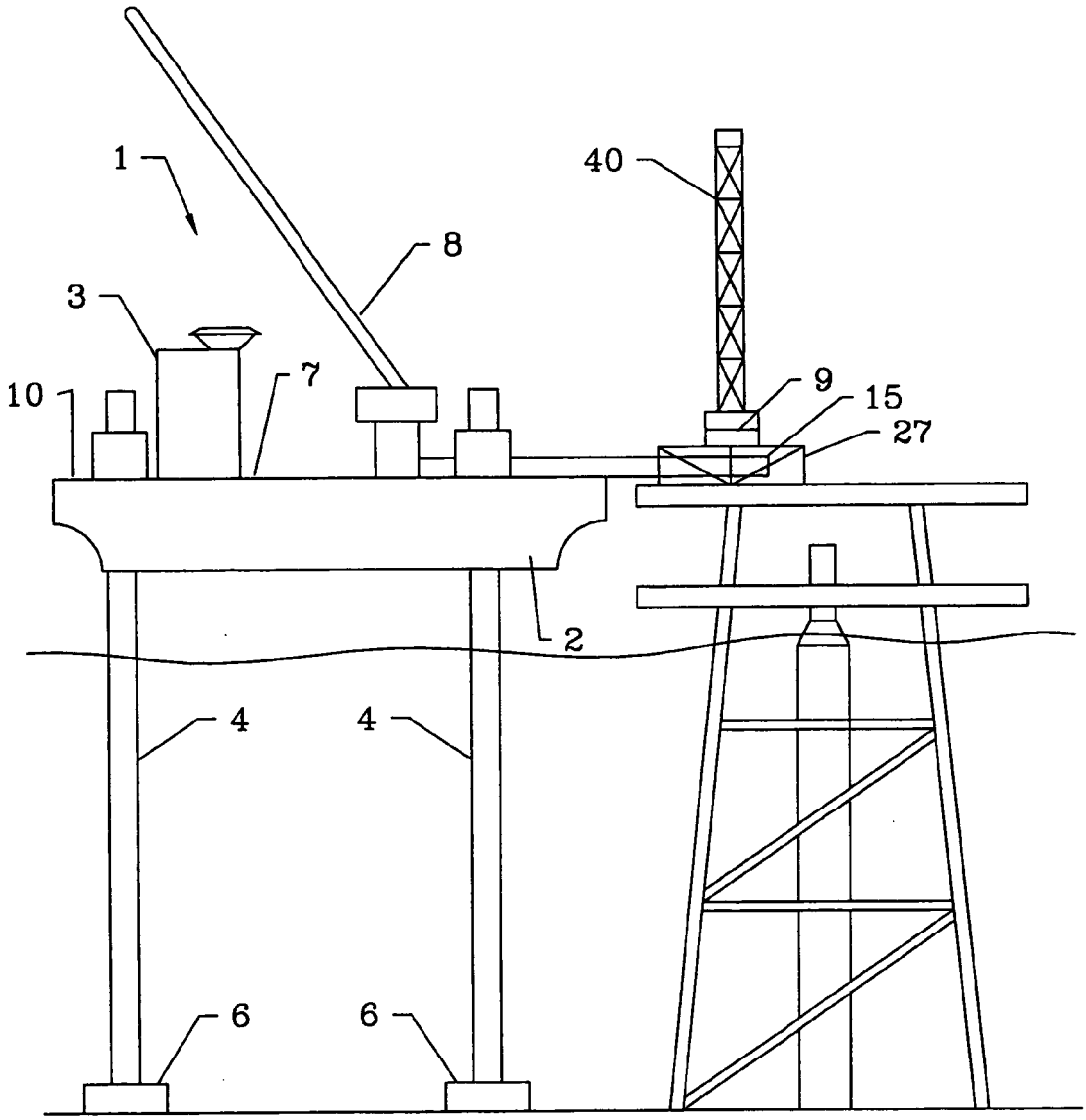
FIG. 5D is a side view showing a preferred embodiment of the jack-up workover rig lowering its workover floor unit onto skid beams on an offshore platform.
Figure 5E:
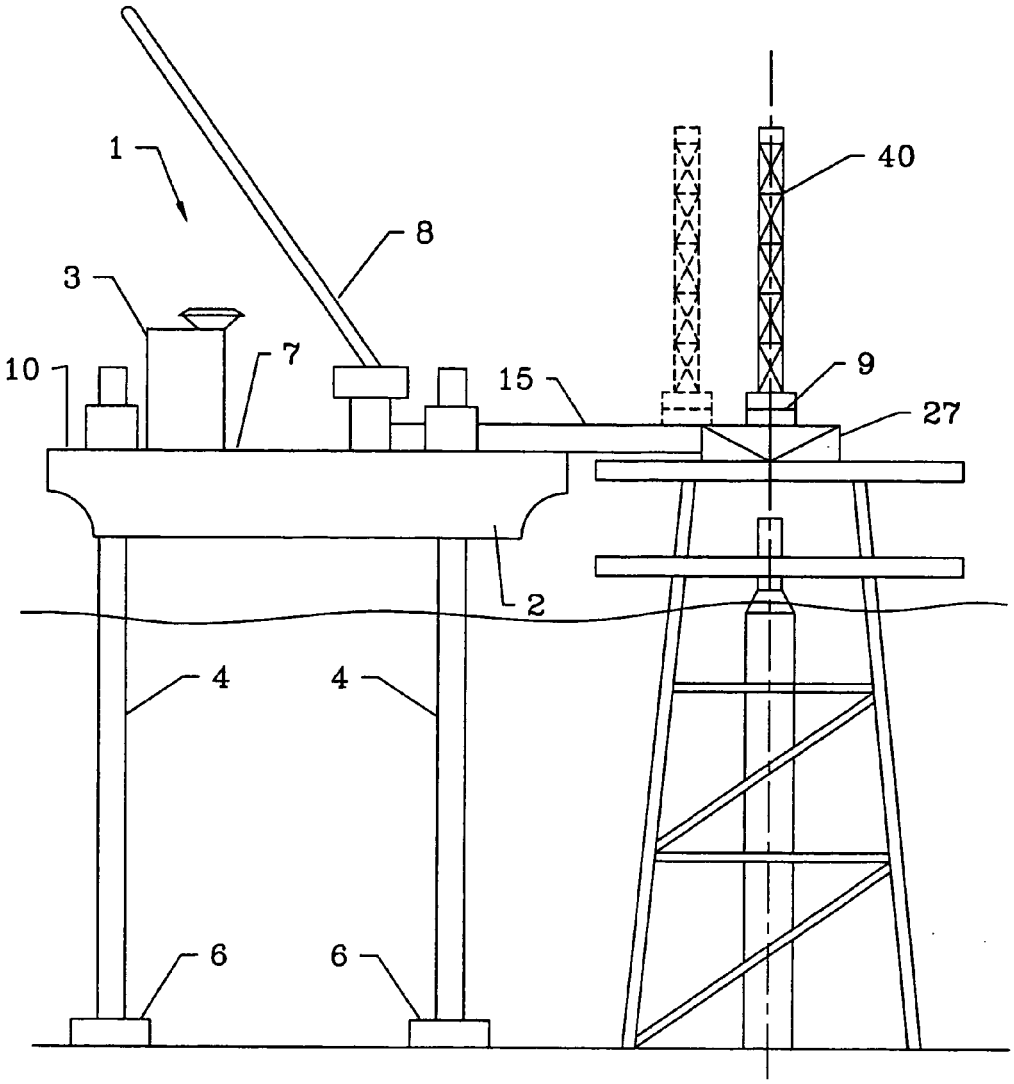
FIG. 5E is a side view showing a preferred embodiment of the jack-up workover rig using its extensible frame to drive the skid beams and detached workover floor unit across the surface of an offshore platform.
Figure 6A:
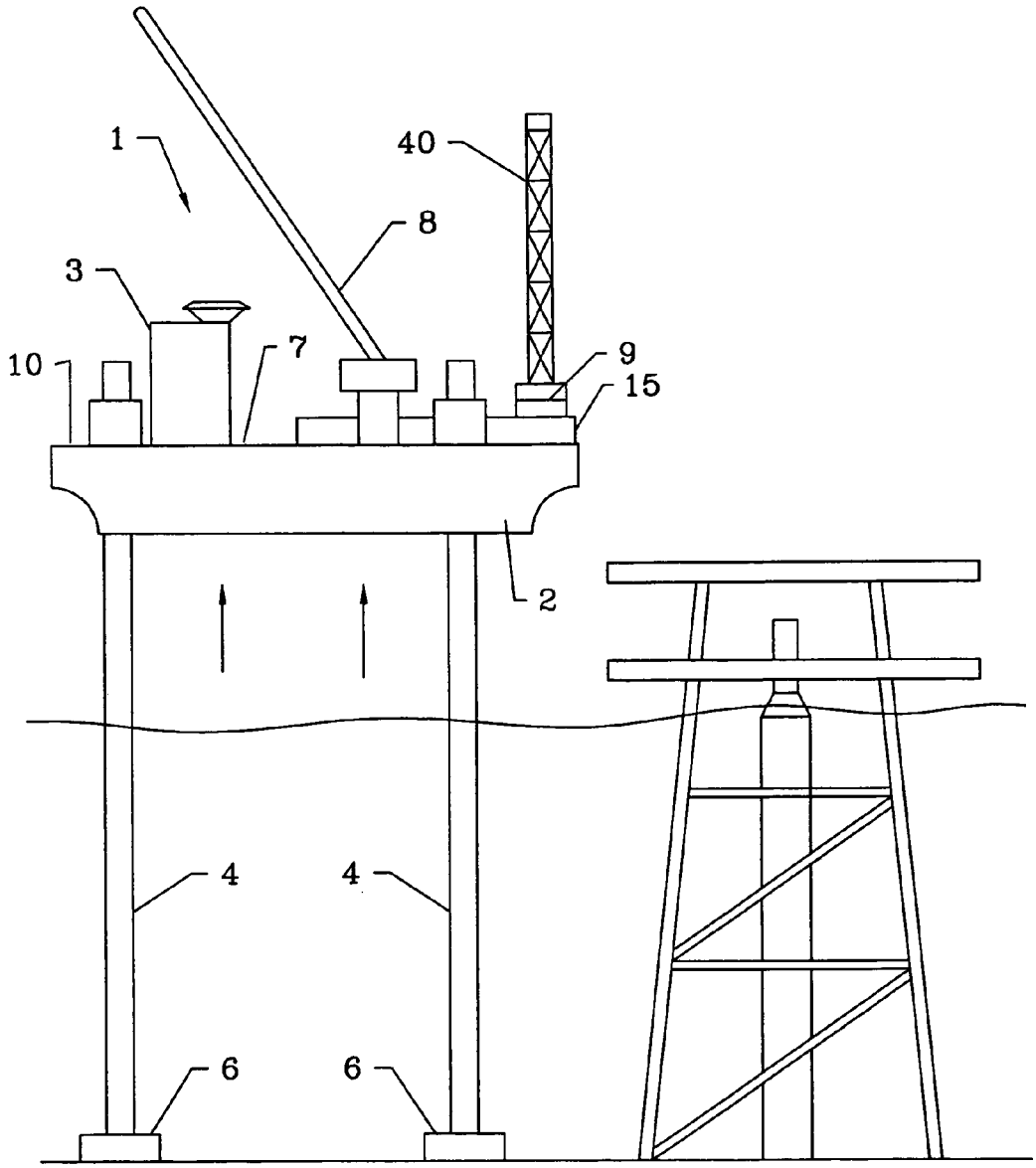
FIG. 6A is a side view showing a preferred embodiment of the jack-up workover rig jacking up into position adjacent to an offshore platform.
Figure 6B:
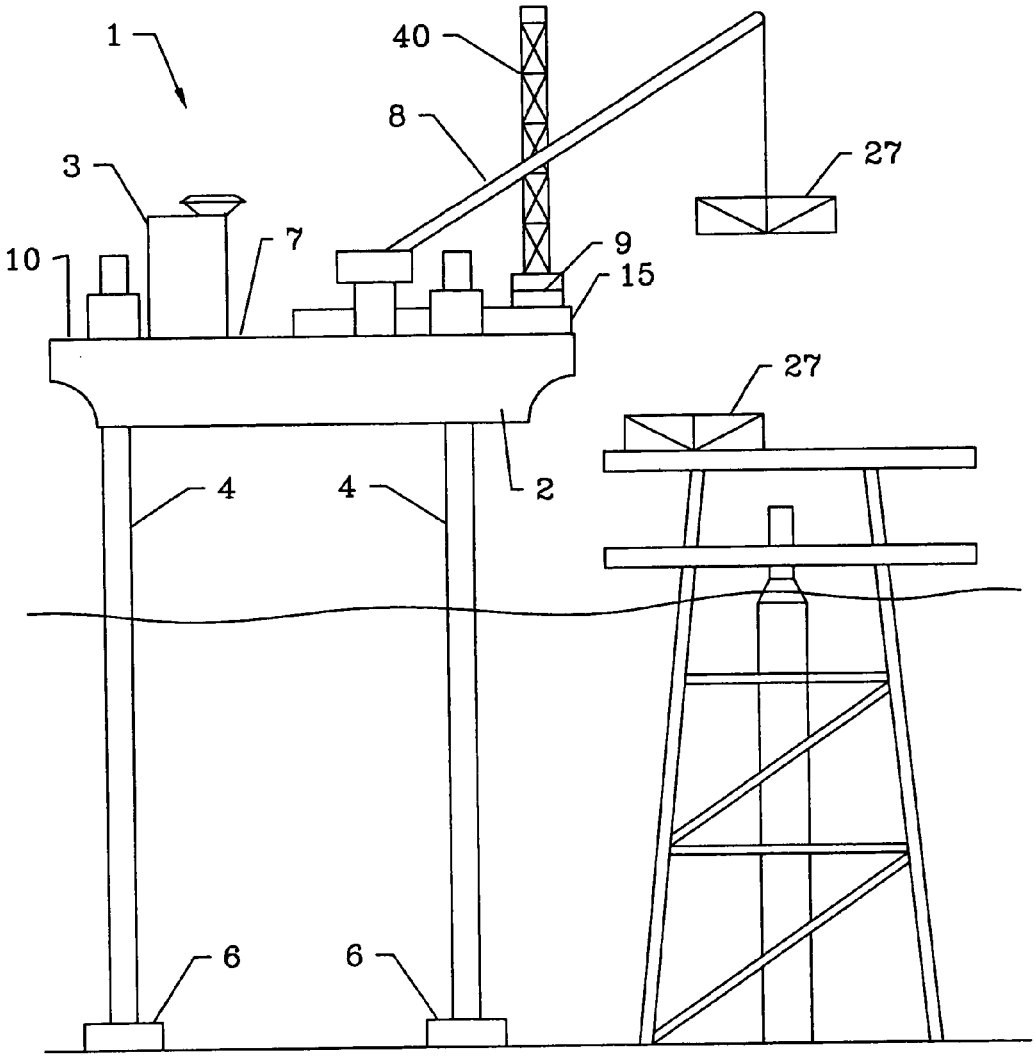
FIG. 6B is a side view showing a preferred embodiment of the jack-up workover rig using a crane to position skid beams on an offshore platform.
Figure 6C:
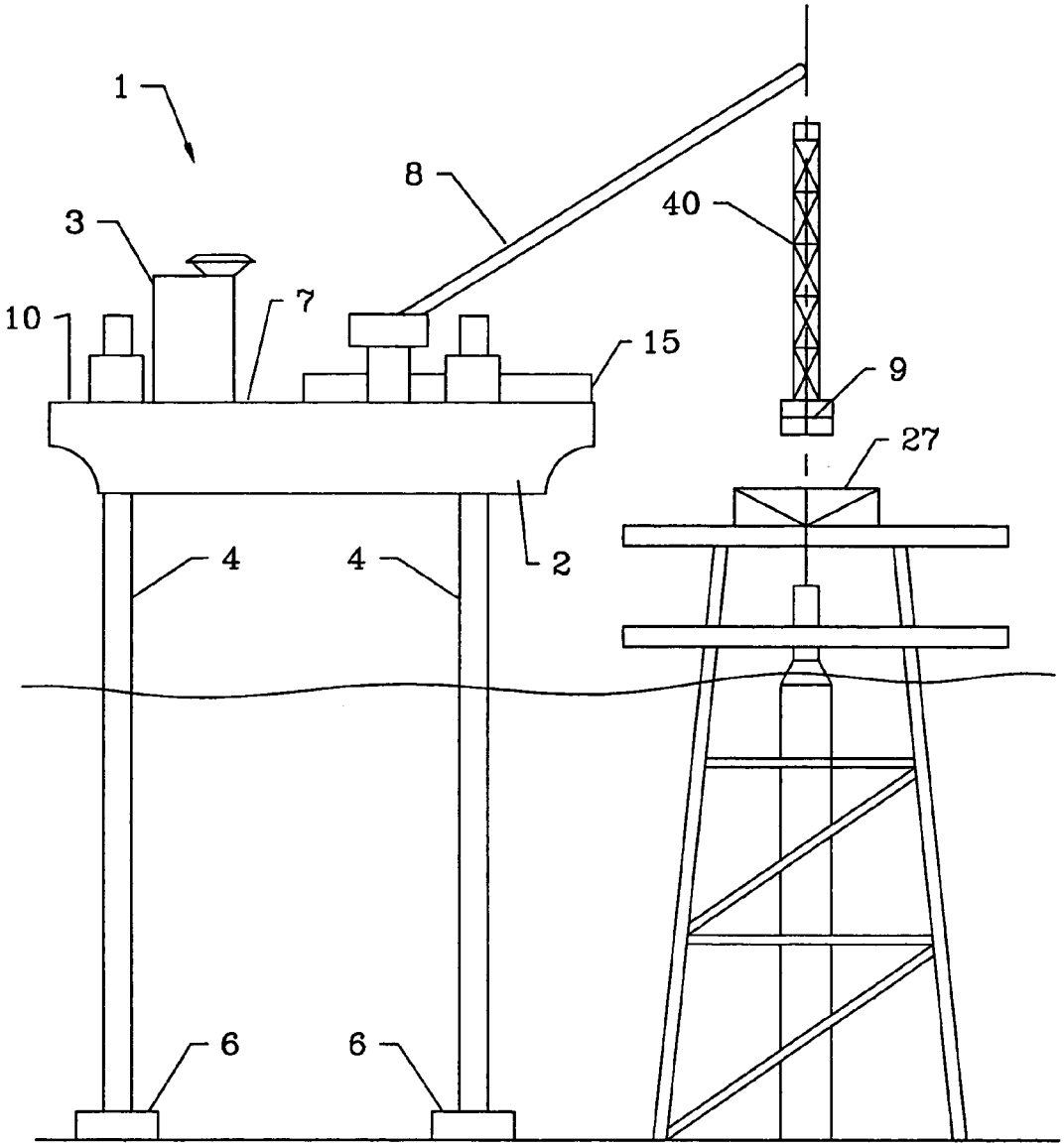
FIG. 6C is a side view showing a preferred embodiment of the jack-up workover rig using a crane to remove the workover floor unit from the vessel and position it on skid beams on an offshore platform.
Figure 7:
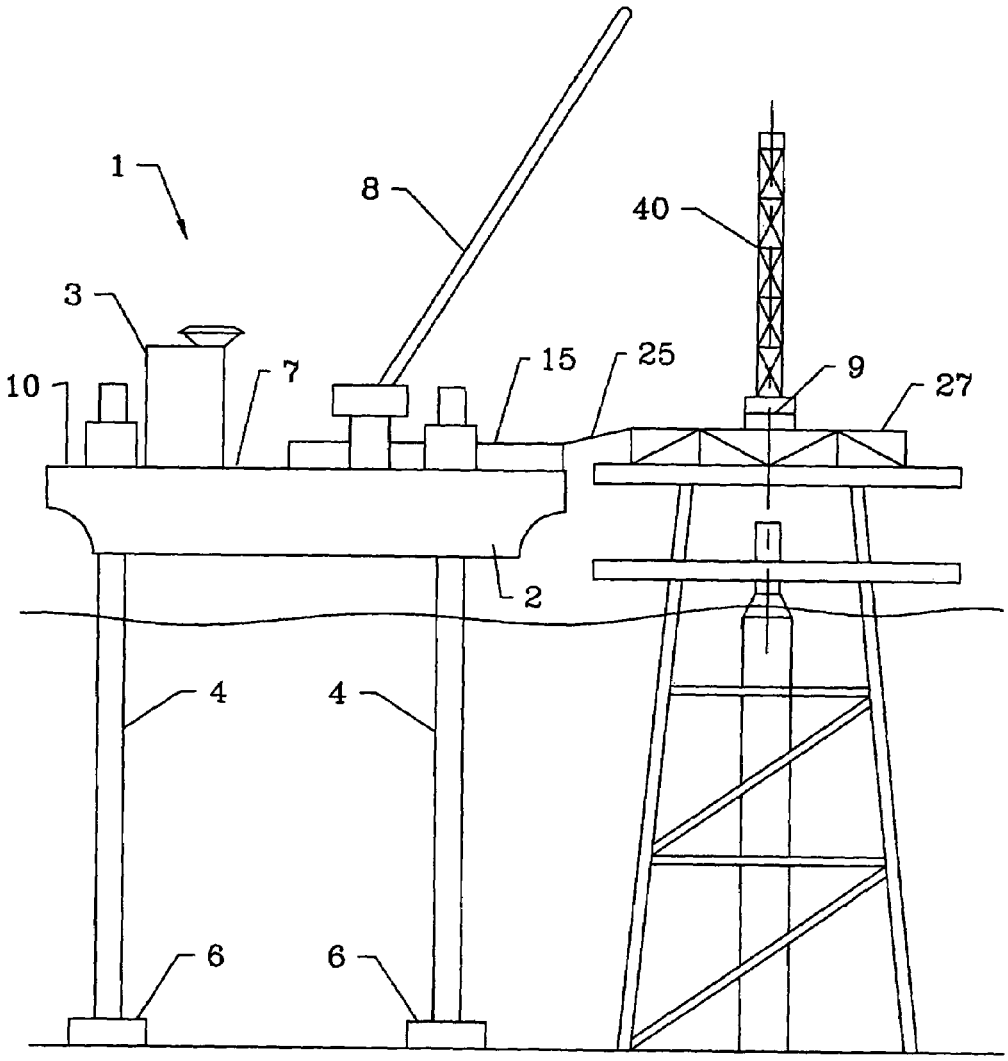
FIG. 7 is a side view showing a preferred embodiment of the jack-up workover rig with the workover floor unit detached and in place on an offshore platform.
Figure 8:
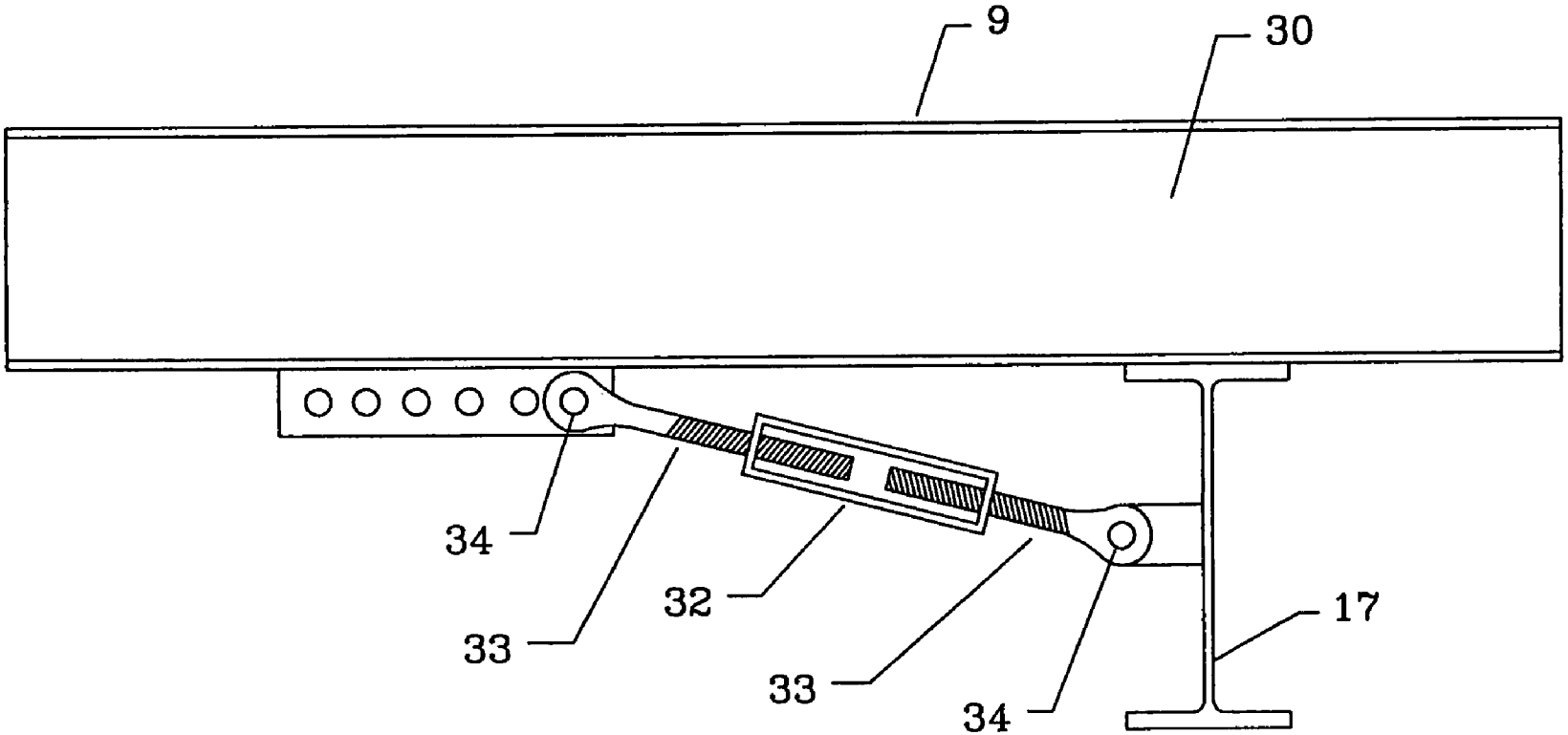
FIG. 8 is a side view showing a preferred embodiment of the tumbuckles connecting the workover floor unit to the extensible frame.
Figure 9:
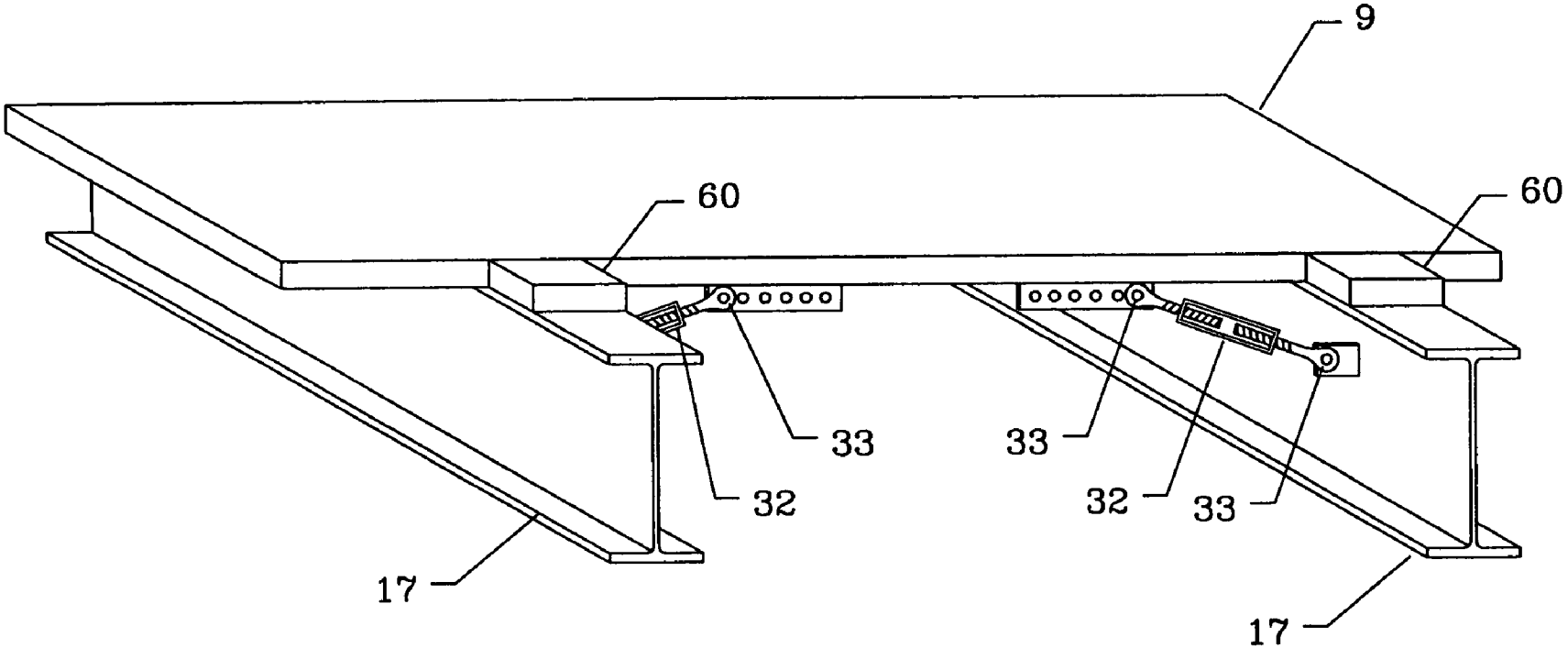
FIG. 9 is a perspective view showing a preferred embodiment of the tumbuckles connecting the workover floor unit to the extensible frame.
Figure 10:
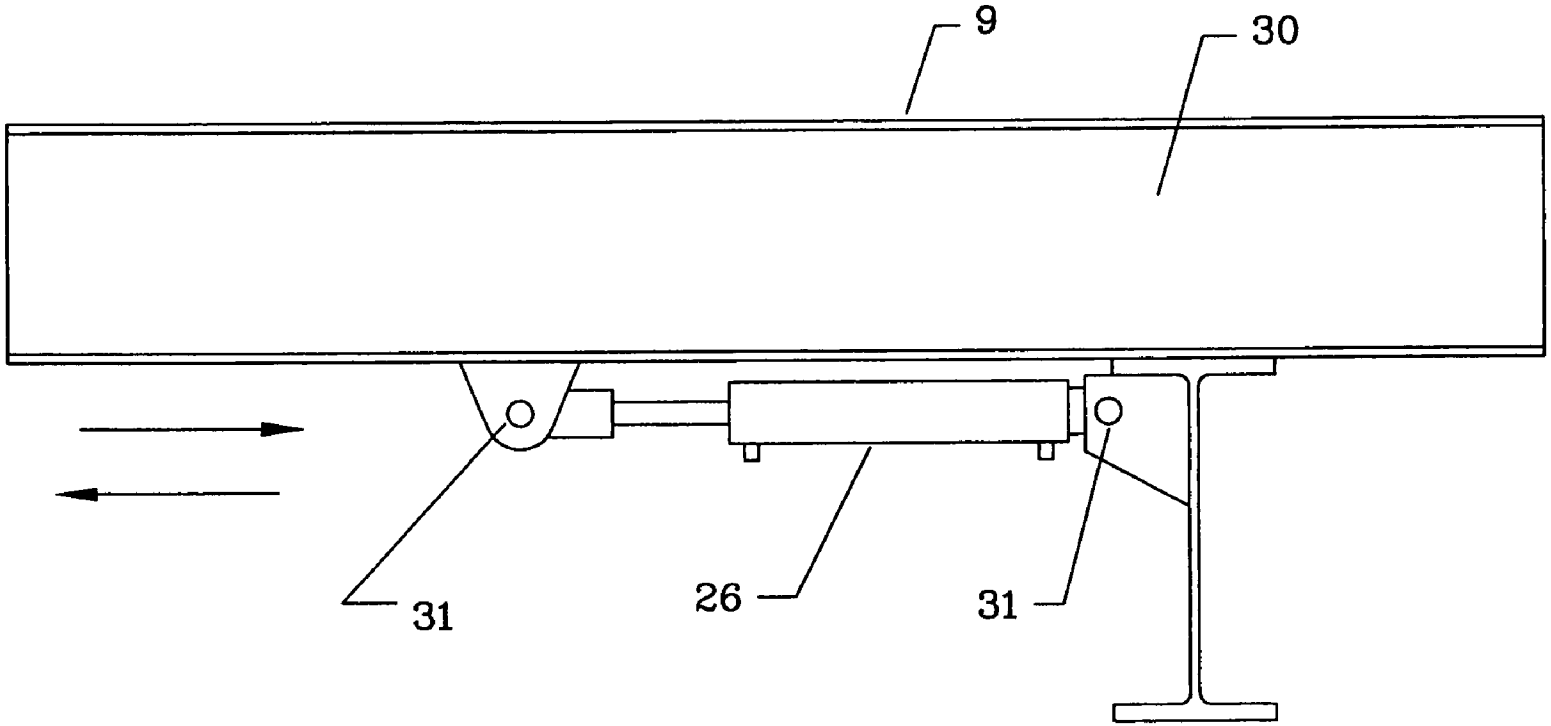
FIG. 10 is a side view showing a preferred embodiment of the hydraulic rams and cylinders configured to move the workover floor unit laterally relative to the extensible frame.
Figure 11:
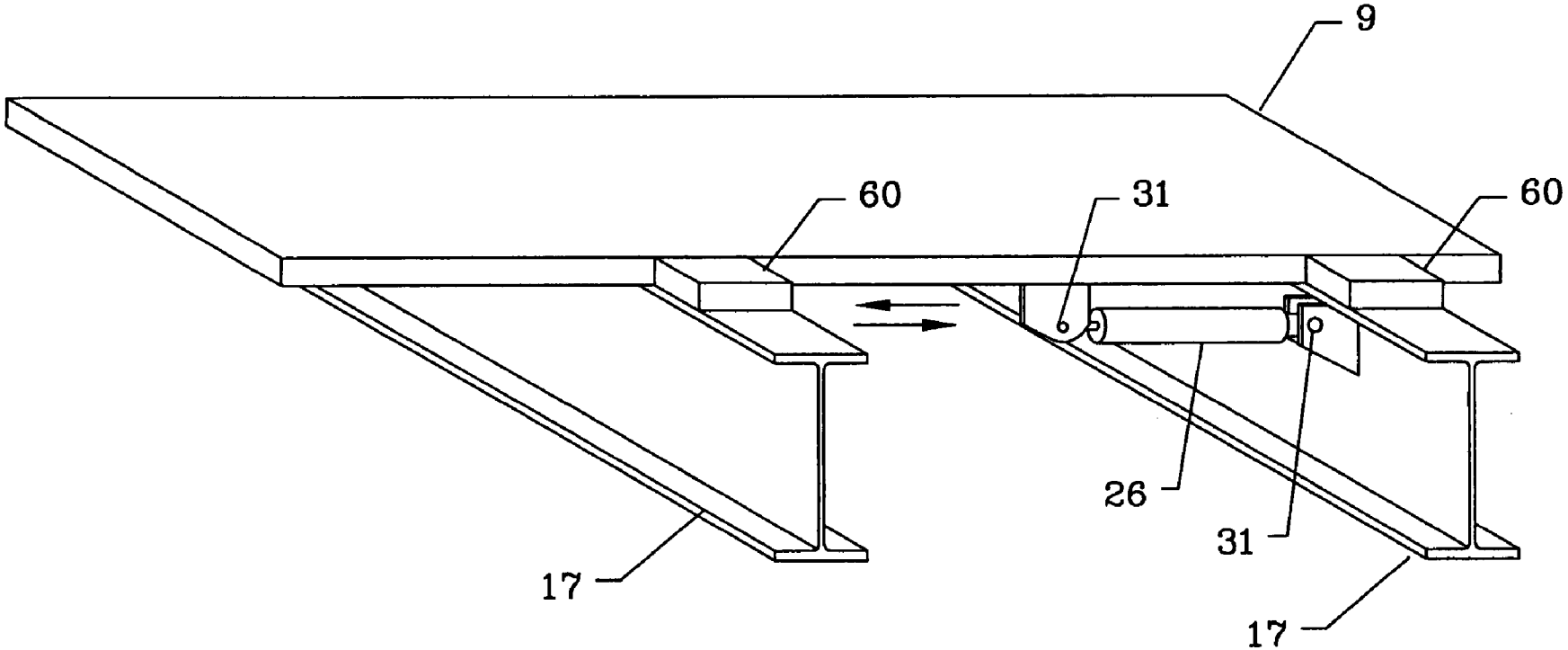
FIG. 11 is a perspective view showing a preferred embodiment of the hydraulic rams and cylinders configured to move the workover floor unit laterally relative to the extensible frame.

The preferred embodiment comprises a jack-up workover rig 1 comprising a vessel 2 which may be a barge or a motor vessel. In either case, vessel 2 should have a thrust source 3 in the form of the primary engine on a motor vessel or a tug boat in the case of a barge. A bow thruster may be included as well to provide additional mobility to vessel 2.

A plurality of jack-up legs 4 are provided on vessel 2, typically three to four such legs 4 are provided and the preferred embodiment contains three. Jack-up legs 4 are provided with at least one jack up motor 5 configured to raise and lower legs 4. Preferably, each leg 4 has its own jack motor 5. Each leg 4 has a foot end 6. Preferably each foot end 6 is provided with a wide base to prevent leg 4 from sinking into the bed of the water body. When vessel 2 has motored into position, jack motors 5 will lower legs 4 until the foot ends 6 reach the bed of the water body. By continuing to extend legs 4 after foot ends 6 reach the bed, vessel 2 may be raised on legs 4 to a desired height. The manufacture and operation of such jack up mechanisms are well known to those in the art. Examples may be found in U.S. Pat. No. 6,523,491 to Moïse, et al. and the references cited therein, which are hereby incorporated by reference, to the extent they are not contrary to the teachings herein.

Vessel 2 has a deck 7 having an outer perimeter 10, preferably ringed with a bumper 11. Deck 7 will preferably have numerous tools and devices provided for the conduct of the vessel's task, such as racks for storing drill stem and other tubular materials, drilling mud pumps, drilling mud mixers, hydraulic power pumps, electric generators, air compressors, and etc. Chief among the deck tools in the present application will be at least one and preferably two cranes 8. Cranes 8 are preferably permanently mounted to deck 7, but may be separate machines as well. In the preferred embodiment, at least one crane 8 should have a lift capacity of at least about 144 tons and should be able to lift and extend loads of this amount at least about sixty feet. Suitable cranes are manufactured by Tech Crane. Preferably cranes 8 should be mounted proximate to the bow of vessel 2.

Vessel 2 will also have a workover floor unit 9. Workover floor unit 9 contains the primary workover tools. These include at least a winch or drawworks 12, a derrick 40, cable 41, and pulleys and/or a block and tackle; a workover motor 13 for driving drawworks 12; a well aperture 14 to provide access through workover floor unit 9 to the well to be serviced; an accumulator unit 42 to power and control blow out preventers in the well; and a choke manifold 43 to safely bleed off pressure in the well line. Other equipment which may be included on a preferred workover floor unit 9 include a pipe setback 51 where drill stem and other equipment may be stacked when being pulled from a well, a gas buster 50 for safely venting gas from a well, an air tugger 52 for lifting equipment and pipe, fuel tanks 53, hydraulic tanks 54 and pumps, water tanks, and stand pipe manifolds 56 to connect workover fluid to the well lines.

In the preferred embodiment, workover floor unit 9 is made of ¼ inch steel plate mounted over steel beams 30. Steel beams 30 will be positioned substantially perpendicular to and will rest upon cantilever skid beams 17, discussed below. Workover floor unit 9 is preferably provided with a pipe handrail running around the perimeter of workover floor unit 9. The handrail will help prevent falls from workover floor unit 9.

Workover floor unit 9 is preferably mounted on an extensible cantilevered frame 15. Cantilevered frame 15 comprises a pair of parallel support beams 16 mounted to vessel 2. A pair of cantilever skid beams 17 rests on support beams 16. Cantilever skid beams 17 and support beams 16 are preferably made of steel and "I" shaped in cross section. Thus, the lower flat horizontal portion of cantilever skid beam 17 may rest upon the upper flat horizontal portion of support beam 16.

In the preferred embodiment, a pair of tension clamps 18A and 18B and a compression clamp 19 secure cantilever skid beams 17 to support beams 16. By partially loosening clamps 18A, 18B and 19, cantilever skid beams 17 may be slid over support beams 16. A track mechanism may be employed to keep beams 16 and 17 in alignment if desired; however, clamps 18A, 18B, and 19 serve this purpose if some tension is kept in the clamps.

By opening clamps 18A, 18B and 19 entirely, cantilevered frame 15 may be removed from vessel 2 entirely. In this way, cantilevered frame 15 could be transferred to another vessel, if desired.

At least one hydraulic ram and cylinder 20 is provided to drive cantilever skid beams 17 over support beams 16. Preferably, a separate hydraulic ram and cylinder 20 is provided for each cantilever skid beam 17. By extending and retracting hydraulic ram and cylinder 20, cantilever skid beams 17, cantilevered frame 15, and workover floor unit 9 may be extended and retracted.

Each cantilevered skid beam 17 has a first end 21 proximate to hydraulic ram and cylinder 20 and a second end 22 distal from hydraulic ram and cylinder 20. To maximize the length cantilevered frame 15 may be extended while minimizing the length of hydraulic ram and cylinder 20, ram 23 is configured to engage cantilever skid beam 17 at several points between first end 21 and second end 22. Initially, ram 23 will be attached to cantilever skid beam 17 at the attachment point most distal from first end 21. Ram 23 will be extended to its maximum length, and then detached from cantilever skid beam 17. Next ram 23 will be retracted until its end is aligned with the next most distal attachment point from first end 21. Ram 23 will again be extended to its maximum length and the process will be repeated.

A catwalk 24 is preferably provided along the length of extensible cantilevered frame 15. A pipe slide 25 preferably connects catwalk 24 with frame 15. This will allow pipe that is extracted on workover floor unit 9 to be removed via pipe slide 25 to catwalk 24 where workers can properly stow it until the pipe is needed again. A folding handrail is preferably provided at the external edges of catwalk 24 which can folded flat to facilitate the extension and retraction of frame 15 and then raised and locked into place to help prevent falls from catwalk 24.

Workover floor unit 9 is configured to be moved laterally (perpendicular to cantilever skid beams 17) as well as extended and retracted. In the preferred embodiment, one or more hydraulic rams and cylinders 26 (preferably two) are provided. Each hydraulic ram and cylinder 26 is mounted to one of the workover floor unit beams 30 at one end and to a cantilever skid beam 17 at the other end. By extending and retracting, these hydraulic rams and cylinders 26 may move workover floor unit 9 laterally back and forth relative to cantilever skid beams 17 and more importantly relative to the well being serviced. Mechanical stops 60 are preferably provided fore and aft of workover floor unit 9 on each cantilever skid beam 17. Mechanical stops 60 will help keep workover floor unit 9 aligned. Each hydraulic ram and cylinder 26 is preferably releasably connected to workover floor unit beams 30 and to cantilever skid beams 17 by way of detachable pins 31. This will facilitate the detachment of workover floor unit 9 from vessel 2, as discussed below.

Workover floor unit 9 is preferably configured to be detachable from extensible cantilevered frame 15. In a preferred embodiment, workover floor unit 9 is attached to extensible cantilevered frame 15 by a plurality, preferably four, tumbuckles 32 and threaded steel rod pairs 33. Steel rod pairs 33 will be releasably connected to cantilever skid beams 17 and workover floor unit beams 30 with detachable pins 32. Tumbuckles 32 connect and tighten each half of threaded steel rod pair 33 to the other. By tightening tumbuckles 32, the connection between workover floor unit 9 and cantilever skid beams 17 and vessel 2 may be secured. By loosening tumbuckles 32, pins 34 holding either or both halves of steel rod pairs 33 to their respective beams (17, 30) may be removed, disengaging the primary structural connection between workover floor unit 9 and frame 15 and vessel 2. In addition to tumbuckles 32, hydraulic ram and cylinders 26 should also be disengaged. Also, a plurality of lines that may include lines for electrical, air, hydraulic, and water will connect vessel 2 with workover floor unit 9. These lines should be disconnected if workover floor unit 9 is to be removed. These lines are preferably provided on a retractable spool with extension capacity of about sixty feet which may be used when workover floor unit is being extended without removing workover floor unit from vessel 2.

Once workover floor unit 9 is fully disconnected from vessel 2, workover floor unit 9 may be lifted from vessel 2 with crane 8 and deposited where desired. Alternatively, workover floor unit 9 may be extended on extensible cantilevered frame 15 until workover floor unit 9 is over a desired location. Vessel 2 may then be lowered by retracting legs 4 until workover floor unit 9 is resting on the desired location. At this point, workover floor unit 9 would be disconnected from extensible cantilevered frame 15, and frame 15 would be retracted, leaving workover floor unit 9 where desired.

Vessel 2 will preferably carry a plurality of "I" shaped steel skid beams 27. Prior to depositing workover floor unit 9 in a location external to vessel 2, the operator of vessel 2 will preferably deposit at least two skid beams 27 on the surface of the desired location, typically an offshore platform. Crane 8 will preferably be used to position skid beams 27 perpendicular to the length workover floor unit 9 will occupy in its desired position. Once skid beams 27 are in place, they will preferably be welded to the platform surface. Workover floor unit 9 may then be deposited so that workover floor unit beams 30 rest on and are supported by skid beams 27 in the desired location, either using crane 8 or by extending frame 15 and then retracting legs 4 as described above. Workover floor unit 9 is preferably chained to skid beams 27 to hold workover floor unit 9 in place. By engaging extensible cantilevered frame 15 with skid beams 27, skid beams 27 and workover floor unit 9 may be pushed or pulled over the external surface of the work area by extending or retracting frame 15. Obviously, this must take place before skid beams 27 are welded into place. Once workover floor unit 9 is in its desired location, the various lines connecting workover floor unit 9 with vessel 2 may be reattached so that the equipment on workover floor unit 9 may be operated in the remote location. Many of the systems these lines power, such as hydraulics, compressed air, water, or electricity, may be duplicated on workover floor unit 9 if desired, reducing or eliminating the dependence of workover floor unit 9 on vessel 2.

Other uses and embodiments of the invention, equivalent to those disclosed herein, will occur to those skilled in the art, and are intended to be included within the scope and spirit of the following claims.

I claim:

1. A jack-up workover rig configured to operate in a water body having a surface and a bed, said workover rig comprising:

a vessel comprising a hull, a deck having an outer perimeter, and a thrust source configured to propel said vessel through said water body;

a jack-up mechanism comprising a plurality of extensible legs, each said leg having a foot end, said jack-up mechanism further comprising at least one jack-up motor configured to raise and lower said legs, whereby said vessel may be raised above the surface of the water body by continuing to extend said legs after said foot ends of said legs reach the bed of the water body;

an extensible cantilevered frame mounted to said vessel;

at least one frame drive configured to extend and retract said cantilevered frame in a direction generally perpendicular to said legs;

a workover floor unit comprising a work platform having a well aperture, drawworks, a derrick, a cable, a workover motor, an accumulator unit, and a choke manifold, said workover floor unit releasably mounted to said cantilevered frame whereby said workover floor unit may be extended past said perimeter of said vessel deck up to a first distance by extending said cantilevered frame; and a crane positioned on said vessel and configured to lift said workover floor unit from said cantilevered frame, said crane further configured to extend said workover floor unit beyond said first distance from said perimeter of said vessel deck.

2. A jack-up workover rig according to claim 1 wherein said workover floor unit is configured to be horizontally adjustable relative to said extensible frame.

3. A method of servicing an offshore platform using a jack-up workover rig configured to operate in a water body having a surface and a bed, said workover rig comprising a vessel comprising a hull, a deck having an outer perimeter, and a thrust source configured to propel said vessel through said water body, said vessel containing a plurality of skid beams; a jack-up mechanism comprising a plurality of extensible legs, each said leg having a foot end, said jack-up mechanism further comprising at least one jack-up motor configured to raise and lower said legs; an extensible cantilevered frame mounted to said vessel; at least one frame drive configured to extend and retract said cantilevered frame in a direction generally perpendicular to said legs; a workover floor unit comprising a work platform having a well aperture, drawworks, a derrick, a cable, a workover motor, an accumulator unit, and a choke manifold, said workover floor unit releasably mounted to said cantilevered frame whereby said workover floor unit may be extended past said perimeter of said vessel deck by extending said cantilevered frame; and a crane positioned on said vessel; wherein the method comprises:

positioning said vessel in said water body adjacent to said offshore platform;

extending said legs until said foot ends of said legs reach the bed of the water body;

continuing to extend said legs until said vessel deck reaches a desired height above said offshore platform;

positioning at least two of said skid beams on said offshore platform with said crane;

extending said cantilevered frame until said workover floor unit is positioned over said skid beams on said offshore platform;

retracting said legs until said workover floor unit is resting on said skid beams on said offshore platform;

releasing said workover floor unit from said cantilevered frame;

engaging said skid beams with said cantilevered frame; and driving said skid beams by extending said cantilevered frame until said workover floor unit is positioned at a desired location on said offshore platform.

4. A method of servicing an offshore platform using a jack-up workover rig configured to operate in a water body having a surface and a bed, said workover rig comprising a vessel comprising a hull, a deck having an outer perimeter, and a thrust source configured to propel said vessel through said water body, said vessel containing a plurality of skid beams; a jack-up mechanism comprising a plurality of extensible legs, each said leg having a foot end, said jack-up mechanism further comprising at least one jack-up motor configured to raise and lower said legs, whereby said vessel may be raised above the surface of the water body by continuing to extend said legs after said foot ends of said legs reach the bed of the water body; a workover floor unit comprising a work platform having a well aperture, drawworks, a derrick, a cable, a workover motor, an accumulator unit, and a choke manifold, said workover floor unit releasably mounted to said vessel; and a crane positioned on said vessel and configured to lift said workover floor unit from said vessel, said crane further configured to extend said workover floor unit beyond said perimeter of said vessel deck wherein the method comprises:

positioning said vessel in said water body adjacent to said offshore platform;

extending said legs until said foot ends of said legs reach the bed of the water body;

continuing to extend said legs until said vessel deck reaches a desired height above said offshore platform;

positioning at least two of said skid beams on said offshore platform with said crane;

releasing said workover floor unit from said vessel;

moving said workover floor unit from said vessel and positioning said workover floor unit on said skid beams on said offshore platform with said crane.

* * * * *